US005770162A

United States Patent [19]

Niknafs

[11] Patent Number: 5,770,162

[45] Date of Patent: Jun. 23, 1998

[54] HORIZONTAL REGENERATIVE THERMAL OXIDIZER UNIT

[75] Inventor: Hassan S. Niknafs, Stow, Ohio

[73] Assignee: Norton Chemical Process Products Corporation, Stowe, Ohio

[21] Appl. No.: 676,607

[22] Filed: Jul. 8, 1996

[51] Int. Cl.[6] ..... F23B 5/00; B01D 50/00; F01N 3/10; F27D 17/00

[52] U.S. Cl. ..... 422/169; 422/175; 422/206; 422/182; 432/179; 432/180; 110/211; 110/212

[58] Field of Search ..... 422/175, 169, 422/206, 182; 110/211, 212; 432/179, 180

[56] References Cited

FOREIGN PATENT DOCUMENTS

| | | | |
|---|---|---|---|
| 687879 | 12/1995 | European Pat. Off. | F28D 17/02 |
| 90/14560 | 5/1990 | WIPO | F23G 7/06 |

*Primary Examiner*—Lynette F. Smith

[57] ABSTRACT

A regenerative thermal oxidizer unit comprising two heat regenerator units in which a gas to be purified from VOCs passes through the units in an essentially horizontal direction.

4 Claims, 3 Drawing Sheets

HORIZONTAL REGENERATIVE THERMAL OXIDIZER UNIT

BACKGROUND OF THE INVENTION

This invention relates to thermal regenerator units and specifically to units designed for efficient use of recycled heat in thermal oxidizer units where a horizontal layout allows very efficient utilization of space.

Many chemical and petrochemical processes result in an emission of off-gases containing volatile organic components, (referred to in the industry as "VOC"s), many of which are believed to be environmentally harmful. There has as a consequence been a concerted effort to clean up such emissions by removal of VOCs prior to venting the off-gases to the atmosphere.

One such approach is to pass the gases through combustion chambers where they are mixed with fuel and burned. To make this process more efficient the heat generated is typically used to pre-heat the incoming VOC-containing gases. This is done in a thermal regenerator unit. In such a unit the gases exhausted from the combustion chamber pass through a container holding a heat sink media which absorb the heat of combustion. When the heat sink media have reached the desired temperature, the flow is reversed and the incoming gases pass over the heated media and the exhausted gases pass through a second container of heat sink media. This process continues with the flow being reversed as the heat extracted from the exhaust gases reaches the desired level.

Such processes are quite economical and reduce the costs of operating such regenerative units. However since the units are typically added to existing equipment as it is modernized to meet new environmental standards, they must often fit into existing available space rather than be designed as part of the installation before it is constructed. As was indicated above, space must be allocated for twin passages through which the exhaust gases can reach the combustion chamber and this is not easy to accommodate except by installation of vertical towers for the heat exchange. However since the heat sink material has to be changed from time to time, maintenance of such towers is a major problem.

A horizontal thermal regenerative oxidizer unit has now been developed which occupies comparatively little space and is easily maintained being adapted to use modular heat sink units that are readily installed and removed.

GENERAL DESCRIPTION OF THE INVENTION

The present invention provides a horizontal thermal regenerative oxidizer unit comprising a combustion chamber connected to two heat regenerator units housing heat sink media wherein each unit comprises at least first and second compartments in vertically stacked relationship with connecting passageways such that gases passing therethrough pass horizontally in a first direction through the first compartment and then subsequently in the reverse direction through the second compartment.

The heat regenerator units can if desired comprise more than two compartments stacked one above the other with the exhaust gases passing horizontally in alternating directions as they move up, (or down), the stack. Generally however two per unit is preferred.

The compartments preferably are adapted to house heat sink media in the form of porous ceramic blocks with a plurality of obligatory passages. These are sometimes referred to as "honeycomb monoliths". Such monoliths are easily installed and removed as modules and the compartments of the thermal regenerator units are preferably designed with access means to permit such ready installation and removal of such monoliths and hence permit easy maintenance.

DRAWINGS

The invention is illustrated by the flowing drawings:

FIG. 2 is a plan diagram of the equipment illustrated in

Figure 1:
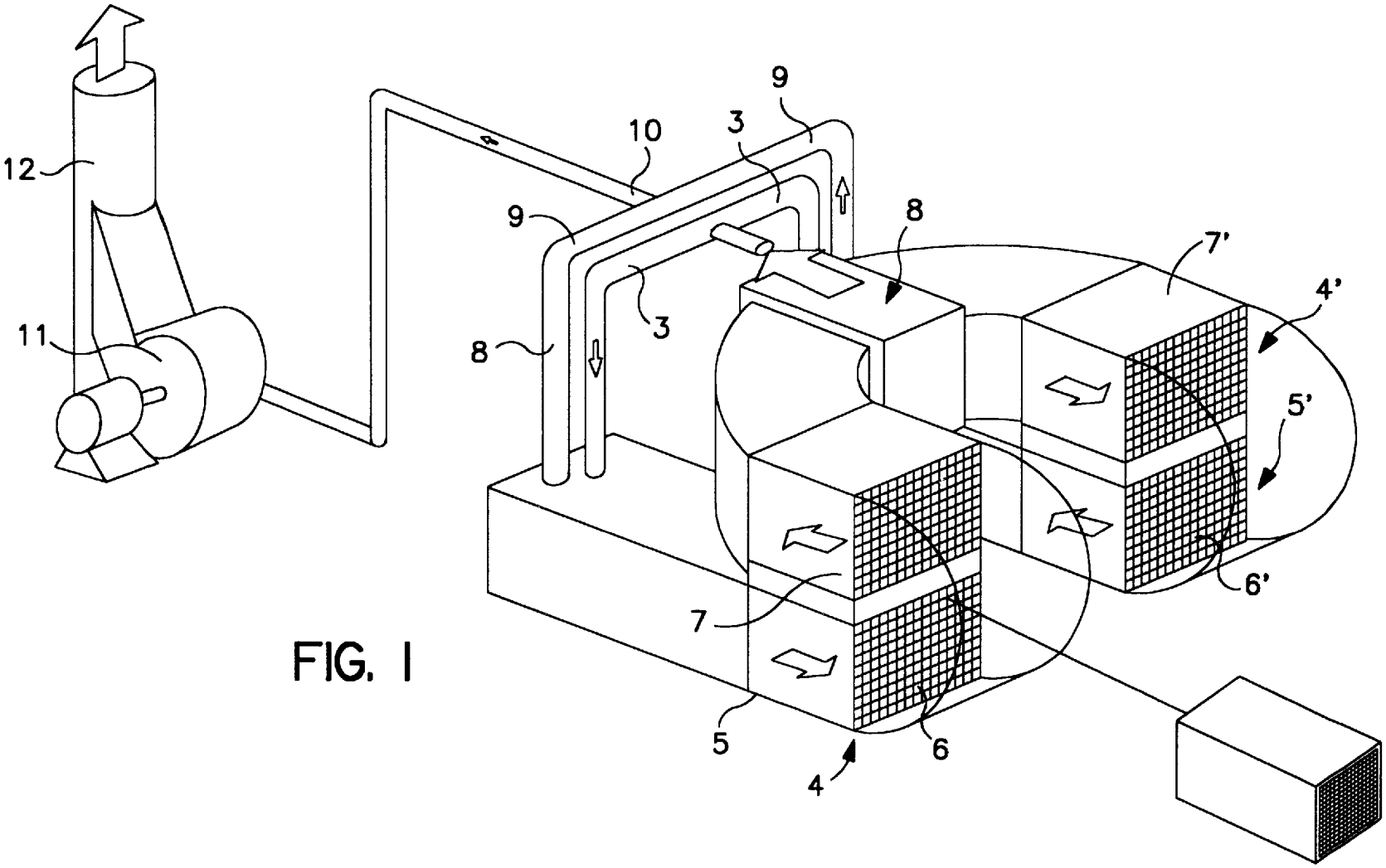
FIG. 1 is perspective view, partly in cut-away section showing an embodiment of the Invention.

FIG. 1 with the arrows indicating the direction of gas passage in a first mode of operation.

Figure 2:
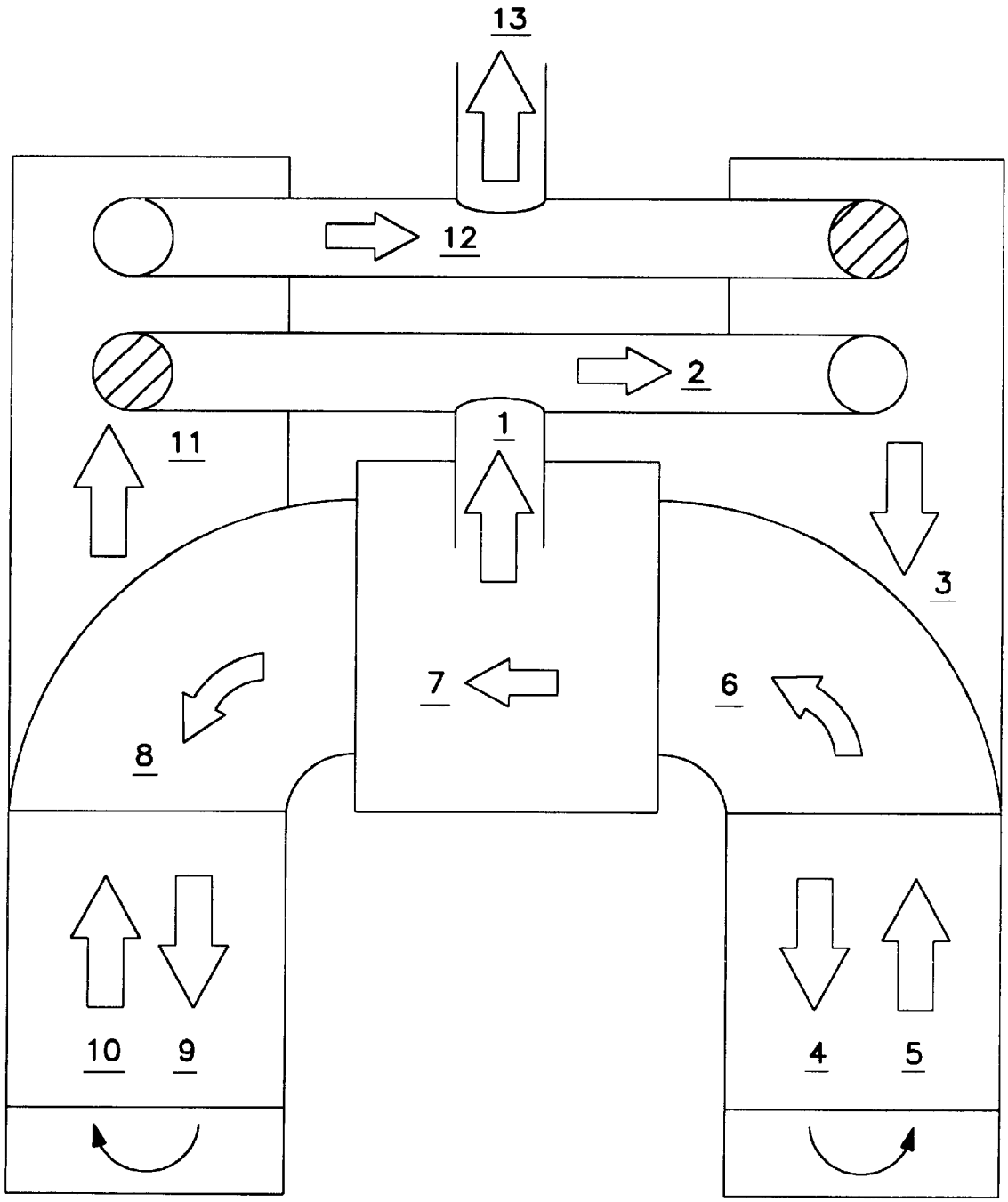
Figure 3:
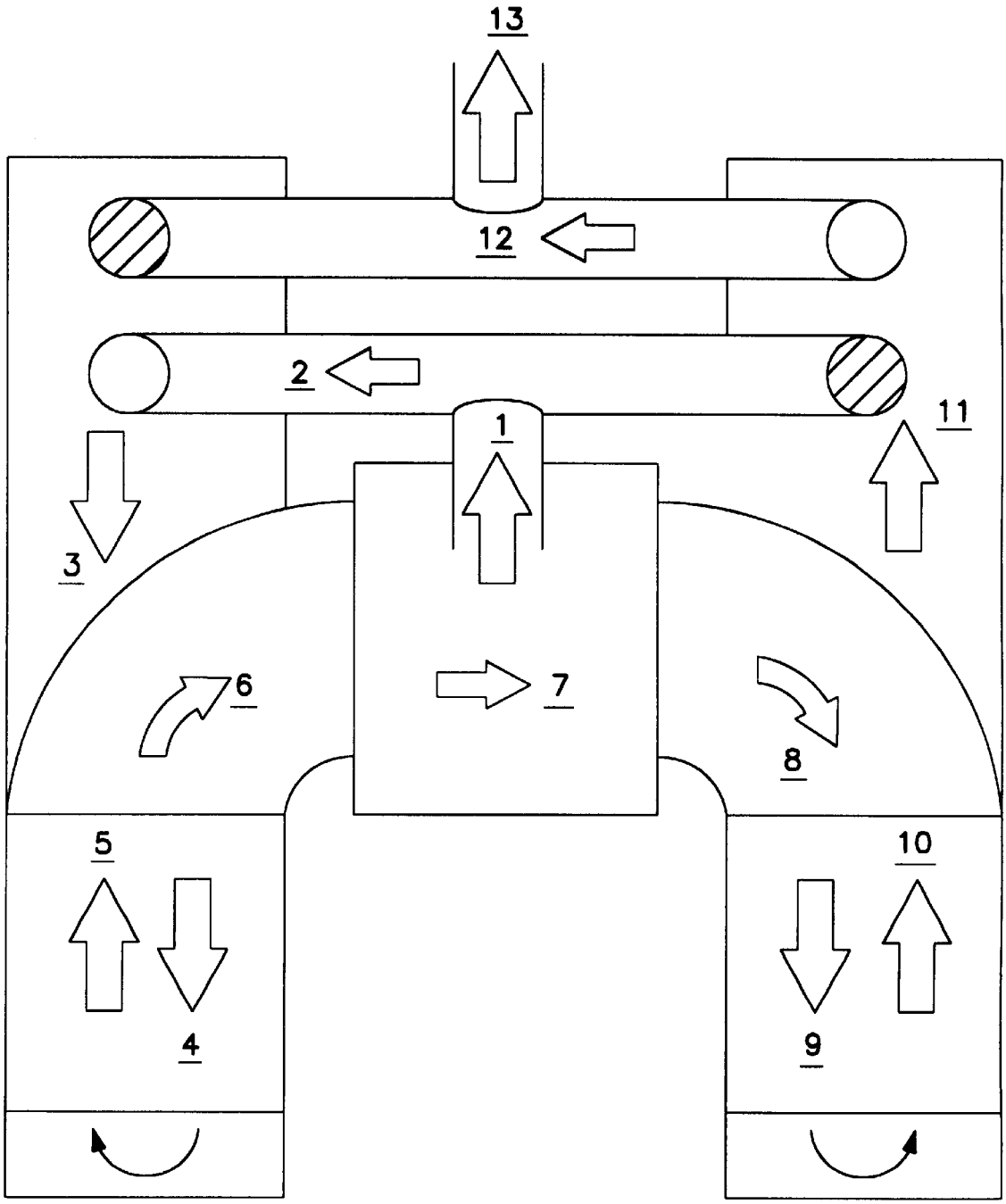

FIG. 3 is similar to FIG. 2 except that the gas flow is reversed to illustrate a second mode of operation.

DETAILED DESCRIPTION OF THE INVENTION

The invention is now described in more detail with specific reference to the Drawings. These illustrate a preferred configuration for the horizontal thermal regenerator oxidizer unit according to the invention but should not be taken as inferring any limitation on the essential scope of the invention claimed herein.

In FIG. 1, process gas containing VOCs enters through pipe, 1, and feeds a first distributor passage, 2, equipped with valves, 3, permitting flow in one direction but not the opposite direction, depending on which of the valves is in the open position. In FIG. 2 the valve on the left is closed whereas in FIG. 3, it is the valve on the right that is closed. From the distributor passage the gas enters a first heat exchanger unit, 4, through a lower level compartment, 5, which contains a honeycomb monolith, 6. From this compartment the gas reverses direction and enters an upper level compartment of the unit, 7, which likewise contains a honeycomb monolith. The gas passes directly from the upper level compartment to a combustion chamber, 8, where it is subjected to temperatures that result in the combustion of the VOCs.

Gas exhausted from the combustion chamber enters a second thermal regenerator oxidizer unit, 4', through an upper level compartment, 7', and then, reversing direction, enters a lower compartment, 5'. Both upper and lower compartments house ceramic honeycomb monoliths, 6'. From the lower compartment the gas enters a second distributor tube, 8, which has valves, 9', allowing gas entering the second distributor tube to exit only through an exhaust port, 10, from which it is drawn by a pump, 11, and vented through a stack, 12.

In FIGS. 2 and 3 the movement of the gas through the system is shown by numbered arrows which indicate the sequence of passage through the indicated portions of the unit. FIG. 2 shows the flow in one direction and FIG. 3 shows the flow in the reverse direction. It will be noted that, by operation of the valves in the first and second distribution tubes, the direction of flow can be instantly reversed with no required down time.

Replacement of a ceramic honeycomb monolith in the upper or lower compartment of the first and second thermal regenerator oxidizer units can readily be accomplished by removal of the end portion of the unit connecting upper and lower compartments, (which is conveniently hung on hinges which are not shown), and then sliding out the monolith to be replaced.

While the heat sink media have been shown as ceramic honeycombs, this is by no means necessary. The monoliths can be substituted by modular units of individual heat sink media or even by dumped heat sink media though this does not afford all the advantages of easy servicing described above. The heat sink media are preferably ceramic but it is possible to use other suitable materials where the composition or temperatures of the gases make this advisable. Where the media are not monoliths they can have any convenient shape such as wheels, tubes, "bow-ties", saddles, cylindrical pellets and balls.

The unit has been described with upper and lower compartments only but this is by no means a limitation on the scope of the invention since each thermal regenerator oxidizer units can also comprise three, four or even more stacked compartments. Generally however two stacked compartments are sufficient.

The units of the invention can be used wherever off-gases from a process comprise VOCs. Typical processes where the unit can be used include removal of traces of organic solvents from the air flow surrounding various coating operations in which the material coated is carried in an organic solvent. Generally the units of the invention are used after recovery of as much solvent as is practicable by other means since thermal regenerative oxidizer units are primarily intended for removal of relatively minor amounts of VOCs.

The unit according to the invention is also extremely useful when the gases to be treated are contaminated with particulate matter. Any such particulate matter will usually be trapped in the heat exchange media, and the pore diameters can be selected with this consideration in mind. Periodic cleaning of the mediathen would also include removal of trapped particulates.

What is claimed is:

1. A horizontal thermal regenerative oxidizer unit comprising a combustion chamber connected to two heat regenerator units housing heat sink media wherein each unit comprises at least first and second compartments in vertically stacked relationship with connecting passageways such that gases passing therethrough pass horizontally in a first direction through the first compartment and then subsequently in the reverse direction through the second compartment.

2. A horizontal thermal regenerative oxidizer unit according to claim 1 in which each heat regenerator unit comprises an upper and a lower compartment.

3. A horizontal thermal regenerative oxidizer unit according to claim 1 in which each compartment of each heat regenerator unit comprises a ceramic honeycomb monolith heat sink media.

4. A horizontal thermal regenerative oxidizer unit according to claim 1 in which each compartment is provided with access means adapted to permit ready removal of the heat exchange media therein.

* * * * *